US009408471B2

(12) United States Patent
Higa

(10) Patent No.: US 9,408,471 B2
(45) Date of Patent: Aug. 9, 2016

(54) COUNTERWEIGHT PILLOW SLING SLEEPING AID

(71) Applicant: Aoren Endeavors LLC, Kapolei, HI (US)

(72) Inventor: Aran Higa, Kapolei, HI (US)

(73) Assignee: AOREN ENDEAVORS LLC, Kapolei, HI (US)

( * ) Notice: Subject to any disclaimer, the term of this patent is extended or adjusted under 35 U.S.C. 154(b) by 0 days.

(21) Appl. No.: 14/055,755

(22) Filed: Oct. 16, 2013

(65) Prior Publication Data

US 2014/0259424 A1 Sep. 18, 2014

Related U.S. Application Data

(60) Provisional application No. 61/794,531, filed on Mar. 15, 2013.

(51) Int. Cl.
*A47C 7/38* (2006.01)

(52) U.S. Cl.
CPC ..... *A47C 7/383* (2013.01)

(58) Field of Classification Search
CPC ..... A47C 7/38; A47G 9/10
USPC ..... 5/636, 630, 644, 647, 650, 640, 646; 297/393
See application file for complete search history.

(56) References Cited

U.S. PATENT DOCUMENTS

| | | | | |
|---|---|---|---|---|
| 16,300 | A | 12/1856 | Wilson | |
| 98,859 | A | 1/1870 | Fast | |
| 382,949 | A | 5/1888 | Campbell | |
| 673,872 | A | 5/1901 | Von Hillern-Flinsch | |
| 1,579,585 | A * | 4/1926 | Wieder | A47C 7/383 297/392 |
| 4,560,201 | A | 12/1985 | Scott | |
| 6,859,965 | B1 | 3/2005 | Gourd | |
| 6,957,462 | B1 | 10/2005 | Wilcox | |
| 6,973,691 | B1 | 12/2005 | Cordova et al. | |
| D577,123 | S | 9/2008 | True | |
| 7,722,122 | B2 * | 5/2010 | Mittelstadt | 297/397 |
| 8,333,308 | B2 | 12/2012 | Maginness | |
| 2008/0235877 | A1 * | 10/2008 | Murray et al. | 5/640 |

* cited by examiner

*Primary Examiner* — Fredrick Conley
(74) *Attorney, Agent, or Firm* — Holland & Hart LLP

(57) ABSTRACT

A sleeping aid device for use when a person is in a seated position, which may provide support for one side of the person's head and/or neck in a semi-lateral direction toward one shoulder through a pillow having a filled shape adapted to rest on the shoulder and support the side of the head, and a counterweight sling strap that goes across the body, connected to the pillow, forming a loop for holding the person's forearms. The sling strap may have a length sufficient to allow both forearms when crossed to be rested on its looped length, and a width sufficient to form a sling to stably support both forearms crossed thereon. The length of the sling strap may be adjusted for better balance in holding the person's forearms.

20 Claims, 7 Drawing Sheets

COUNTERWEIGHT PILLOW SLING SLEEPING AID

BACKGROUND OF THE PRIOR ART

Sleep is essential to good health. Lack of sleep can lead to, among other things, irritability, difficulty concentrating, increased stress, and in extreme cases, even death. Yet it is common knowledge that many people are sleep deprived. This unhealthy condition can result from many factors such as busy work schedules, stress, lifestyle choices, and an environment that involves physical discomfort, such as one requiring a person to try and sleep in unfamiliar resting positions. Complaints about sleep deprivation due to discomfort are particularly common among persons who must travel long distances in a confined seating space, whether by train, bus, car, plane, etc.

For example, the typical plane passenger may experience anxiety, fatigue, and other unhealthy physiological side effects from the stress of attempting to board a flight on time, environmental conditions inside the cabin (such as pressure, ventilation, relative humidity, noise and vibration), cross-infection from fellow passengers, potentially awkward social exchanges, changes in time zones and meal times, and unnatural seating positions and postures adopted for significant periods during a flight.

Body position and seat comfort in particular play vital roles in the overall traveling experience, since a passenger normally spends most of the duration of travel in a seat. In the case of air travel, for example, many airlines attempt to increase profitability by maximizing the number of seats. Although minimum requirements for aircraft seat spacing may exist, such standards were likely designed to align with goals of safety (being able to evacuate in a certain amount of time, etc.) rather than comfort, and thus seating space is too often very limited. Many airline passengers complain of discomfort while flying and of resulting sleep deprivation and desynchronosis ("jet lag").

Passengers seated in the central position of a three or more seat row in particular often complain of discomfort on flights, due to a feeling of being surrounded and of not being able to comfortably rest to one side or the other without fear of encroaching the space of another passenger's seat. A seat space next to a window, on the other hand, is often coveted because, among other reasons, it may allow a passenger to rest the head to the side against the wall of an airplane cabin. In addition, since economy class seats often recline only to a limited degree, the force of gravity against the body, head, and arm members is not as neutralized as it is when the body is in the fully-reclined sleeping position that most people are accustomed to when sleeping. Specifically, when a person is in a flat-lying sleeping position, a bedframe and mattress normally counter the downward force of gravity on a person's body, head, and extremities, allowing the person to rest more easily. In addition, most people normally use a pillow to elevate the head over the rest of the body, to provide stabilization so that the force of gravity does not pull down the head to the level of the mattress, and to help prevent the neck, back, and shoulder pain that might otherwise occur.

When a person is trying to sleep in a seated body position, however, the downward pull of gravity and any other forces acting on an individual's head must be opposed by some other force, such as a person's neck and shoulders, and neck and shoulder muscles. The neck and shoulders may not reliably maintain such a state of equilibrium of forces when a person is sleeping, which limitation might cause a person's head to jolt when the body attempts to sleep. Furthermore, a simple headrest such as those sometimes found on the back of a seat, while helpful in providing support to the back of the head, usually do not alone effectively equalize all the vector forces acting on the head in the direction from the side of a head facing toward a shoulder.

Several sleeping aid devices have attempted to provide comfort when a person is in a seated body position by equalizing the forces acting on the head, but such devices all present certain disadvantages. The "U"-shaped travel pillow, for example, is usually not designed for use in seats that already provide special support to the back of the head. Furthermore, the "U"-shaped travel pillow's limiting movement of the head in any direction but forward has been criticized by some for causing neck stiffness, and may also limit the head's movement more than a person prefers. Moreover, given the limited degree that many airplane economy-class seats recline, pillow devices that provide support directly behind the head might further limit the degree of recline.

Possibly to attempt to compensate for these deficiencies, other sleeping aid devices have been designed to limit head movement primarily in the forward direction by providing support directly in front of a head or neck. Yet trying to sleep in such a position with the head tilted forward, or with pressure being applied from the forward direction may be an unnatural and/or unfamiliar sleeping position or experience for some people.

Although less common, a few other sleeping aid devices for use in a body position where a person is seated in a seat having a backrest try to achieve a state of equilibrium of the forces acting on the head by utilizing counterweight mechanisms. These counterweight sleeping aid devices may consist generally of a brace or other type of head and neck support, connected to some type of strap that attaches to the wrists or arms, and are designed specifically for use where the person is seated with the head looking straight forward, with the spine straight and back placed flatly against the seat. Moreover, when using such counterweight devices, the tension between the head and neck brace and the arms is normally essentially in the forward and backward directions, with the other lateral vector forces basically balanced between each side of the body, with each arm symmetrically attached to a strap or the same strap. Thus, if one of the arms were not connected to a strap, or in a position different from the other arm, there may be an imbalance of forces acting on the head. In addition, rather than provide comfort for the arm members, some such straps may need to attach to the arms or wrists, and may encumber the arm members with localized pressure. Furthermore, such head and neck braces may not be particularly comfortable.

Moreover, the aforementioned and other prior art sleeping aid devices designed for use when a person is seated in a seat having a backrest generally maintain the head and neck in a neutral straight forward/back position, yet many people are accustomed to and prefer sleeping on their sides, or with the head turned at least partially to the side. Many people (and apparently more women than men) also sleep on their sides in the fetal position, where the arms and hands are held close to the body. Requiring a person who is accustomed to sleeping on the side or in the fetal position, where there are at least some forces acting on the side of a head from the direction of the shoulder, to try and sleep in a straight-forward alignment with the back and head squarely against a seat and headrest, in addition to all of the other factors that make travel a somewhat unnatural experience for the humans, decreases the likelihood that a passenger will achieve a state of sleep, and may also harm the quality of any sleep that is achieved.

Furthermore, even those who may be accustomed to sleeping in a non-side body position certainly do not sleep with the arm members dangling loosely due to the force of gravity. When a person is in a seated position in a seat, loose arm members that do not have proper assistance for opposing the downward pull of gravity may lead to discomfort and make a sleeping state more difficult to achieve. Although certain prior art sleeping aid devices have attempted to solve this problem, none have used a counterweight mechanism that includes a looping strap that loops across the body and has a width configured to stably and comfortably support the person's forearms crossed thereon.

Thus, there is a need for a sleeping aid device for use when a person is seated in a seat having a backrest that more closely replicates the side position and the vector forces in the direction from the shoulder to the side of a head, to which many people are accustomed while sleeping. There is also a need for such a device that assists in neutralizing the force of gravity on the arm members, for example, by comfortably holding one or both arm members close to the body, which may more closely replicate the fetal position to which some are accustomed.

SUMMARY OF INVENTION

An improved counterweight sleeping aid device for use when a person is in a seated position in a seat, which includes a pillow configured to be placed on one shoulder to provide support against one side of the person's head and/or neck from a direction toward the one shoulder, and a sling strap having a length between respective ends thereof connected to opposite ends of the pillow and configured to be positioned around the one shoulder on front and back sides of the person forming a loop across the body and having a width of a lower sling portion thereof configured to stably support the person's forearms (or forearm) crossed thereon. The sling strap length may be adjusted so as to be sufficient to allow one or both forearms when crossed to be rested on its looped length, and the width of the lower sling portion is configured to be sufficient to stably support both forearms crossed thereon. The three dimensional vector forces acting on and created by the crossed forearms (or single forearm) resting in the sling strap, and the three dimensional vector forces acting on the side of the head, neck, and/or shoulders, as well as other experienced forces, may be basically in a state of equilibrium. In an embodiment, the sling strap may have a means for adjusting the length of the strap according to user size, position, and preference. In one embodiment, the length of the strap may be adjusted using a buckle.

Unlike the shape of a pillow designed for providing support to a head while in a straight-forward and back position, a pillow designed for when the head is tilted or turned to the side, however slightly, at least partially at an angle toward the side of the nearest shoulder (and while a person is seated) may have a shape that better accommodates such a position, filling in the space above the shoulder so that the head and neck can be supported in a neutral position. Furthermore, when a person is seated in a seat having a backrest and a headrest, such as those provided by a headrest fixed in some commercial airline seats, this feature may also affect the shape of a pillow of a sleeping aid device—especially where it is intended that the person's head may be able to turn to the side. For example, the pillow of the sleeping aid device described herein may have a filled shape adapted to rest on the shoulder and support the side of the head, such as in one embodiment a pillow shape having an inner side that is semi-concave, with a wider end of the pillow facing forward (towards the front of the person and away from the back). Such a pillow shape, when used as part of the sleeping aid device, may provide adequate support for the head and neck and restrict movement at least partially in the direction from the side of the head toward the nearest shoulder (but not necessarily directly to the side towards the shoulder in a perfectly perpendicular manner). Such a pillow shape may also present the advantage of allowing a user to easily turn the head to an unobstructed side (for example, to converse with a neighbor). In addition, in the case where a person is seated in a seat having a backrest and a head rest, or where head support in the backward direction already exists, such a pillow shape may also allow the head to recline backwards to a greater degree (however slight).

Notwithstanding the aforementioned advantages of a pillow with such a tear-drop shape, other embodiments are anticipated having different pillow shapes, such as for example and not by way of limitation, a half-moon shape having two tapering ends on opposite sides.

As described herein, both ends of a sling strap may be attached to the pillow of the sleeping aid device, forming a loop. The sling strap may have a means for adjusting the length of the sling strap, or may be comprised of or connected to a separate strap portion with adjustable length—in which case the sling strap and the strap with adjustable length may each be connected to the pillow on opposite ends, but still together forming a loop. The sling strap may wrap around the back of the body, under the arm member(s), over the chest, and then connect to the strap with adjustable length, which may be attached to a different or basically opposite end of the pillow. The strap with adjustable length may disconnect or connect, and may be adjusted by means known to those skilled in the relevant art(s) to which the device pertains, such as by a buckle.

The sling strap may have greater width than the strap with adjustable length, and may also be padded, which may allow one or both crossed forearms to rest comfortably therein, close to the body. The wide and padded design of the sling strap, rather than concentrating pressure from the straps in certain localized areas of the forearms or arm members, may allow opposing forces acting on the arm members through the sling strap to disperse across a larger area of the forearms or arm member(s) that may be in contact with the pad, and this in a surprisingly comfortable manner. Furthermore, an object of the sling strap may be to prevent the arms from hanging loosely in an uncomfortable and unguarded state due to the downward pull of gravity.

Regardless of whether one or both forearms are resting in the pad, the weight of the arm member(s) in the sling strap may be countered by the upward force of the straps, which may be connected to the pillow, which pillow may be placed against the head and neck and shoulder areas. These opposing forces may make the straps somewhat taut, and pull the pillow firmly against the neck, head, and/or shoulder (and in the described embodiment, may accomplish this) and normally from an at least partially lateral angle. The resulting force on the pillow may provide support to the head while the head is turned or tilted to the side, thus replicating to a greater degree than other prior art devices a position and experience to which many may be accustomed while sleeping.

In addition, by possibly facilitating rest in a diagonal body position across a seat, and possibly with the torso semi-turned, available space in a seat may also be maximized.

By rearranging the pillow to support the inward curve of the lower back area, thereby filling the space between the lower back and the back of a chair, an embodiment of the device may also function as a lumbar support. When the device is used as a lumbar support, the pad may also rest across the shoulder to help keep the pillow hanging in the desired location of the back.

By simply shifting the pillow from the shoulder area to the side of the hip, with the pad resting across the shoulder, an embodiment of the device may also allow convenient portability. Thus the user may carry the pillow easily from one destination to another without necessarily having to deflate (and inflate) or fold up the pillow for storage. Furthermore, positioned in such a manner, the device may resemble to some degree a purse or bag, which may possibly alleviate potential self-consciousness arising from carrying around a sleeping aid device. Moreover, in some embodiments the sleeping aid device may actually have the functionality of a purse or bag.

Other embodiments of the device may also include a machine washable exterior and/or an interchangeable pillow bladder. Such a pillow bladder may be accessible in one embodiment via a zipper or other similar means. Various surface materials, and cushion materials for the pillow bladder (foam, etc.), may also be utilized according to user preference. In an embodiment the pillow bladder may be inflatable.

Although it is anticipated that the device will have particular application for persons occupying seats on airplanes, buses, trains, and other similar forms of transportation, various embodiments of the device may also provide comfort for persons in a variety of other environments and situations. For example, embodiments of the device may be utilized even where a particular seat does not have the luxury of head support in the backward direction, such as seats that might be found at an office, home, concert, or sporting event.

Embodiments of the device may also have medical applications. For example and not by way of limitation, since some persons will rest the head in a tilted position or to the side even without a side pillow or adequate support, the device may assist in preventing neck craning, and possibly torticollis. It is also possible that the device may assist in reducing incidences of snoring, since sleeping with the head tilted to the side, even when seated (rather than lying flat), may decrease the likelihood that the tongue will collapse into the back of the throat and obstruct breathing. In addition, embodiments of the device may have particular application for persons to whom for health or healing reasons it is recommended to sleep in an upright position. The device may also perform a function similar to that of a typical arm sling, with particular application for a person trying to sleep while wearing an arm sling.

The above description and listed alternative embodiments are considered that of some embodiments only. It is understood that the embodiments shown in the drawings and described above are merely for illustrative purposes and not intended to limit scope. Alterations and modifications of the sleeping aid device described herein, and such further applications of the principles said device, are contemplated as would occur to those skilled in the art(s) to which the device pertains.

DETAILED DESCRIPTION

"Lateral angle" or "lateral direction" is hereby defined as the direction from one side of the head of a person using the described device toward one shoulder. "Pillow" is hereby defined as a filled shape having a filled bulging part adapted to rest on the shoulder and support the side of the head of a person using the device, and a tapering end on at least one side of the bulging part adapted to be coupled to an end of a sling strap. "Tear-drop shape" is defined as a pillow shape having a tapering end on one side, with a back side of the pillow having a connector end for the other end of the sling strap. "Half-moon shape" is defined as a pillow shape having two tapering ends on opposite sides of the pillow shape. "Sling strap" (whether used as "strap" alone or by the term "sling strap") is hereby defined as a strap forming a loop at a lower sling portion thereof that has a sling width sufficient for stably supporting and holding the crossed forearms of a person using the device.

Figure 1:
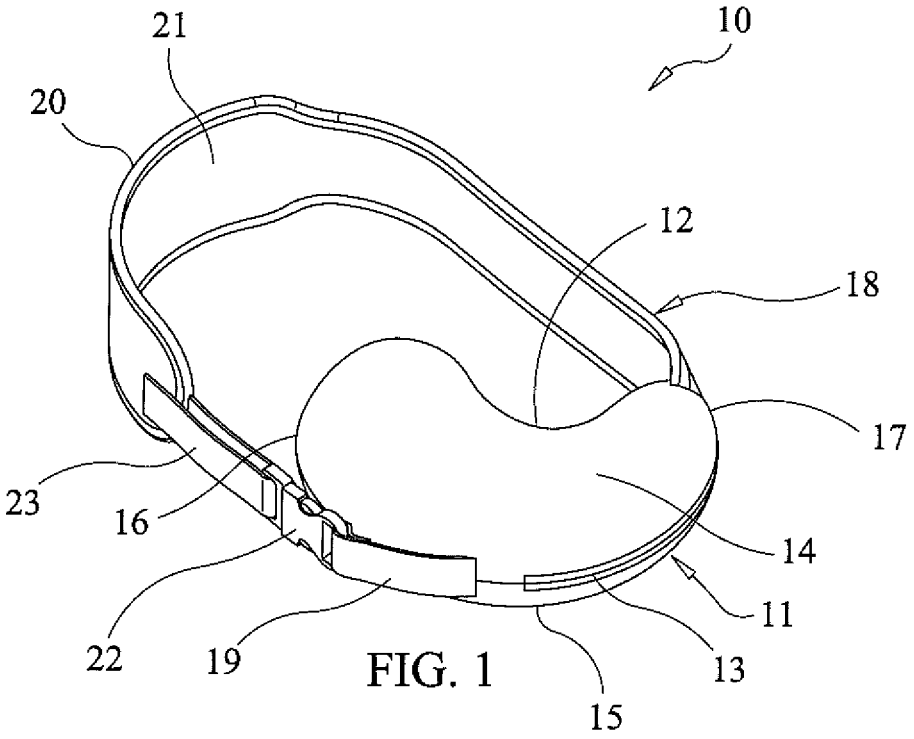
FIG. 1 is an overheard perspective view of a sleeping aid device, showing the top side of a pillow and the inner side of a sling strap.

Referring to the drawings, FIG. 1 illustrates an embodiment of the sleeping aid device 10. The device may include a pillow 11, having a tear-drop shape, such as, in the embodiment described herein, a lopsided oblong/concave shape, having an inner side 12, an outer side 13, a top side 14, a bottom side 15, a front side 16, and a rear side 17.

Attached to the rear side of the pillow 17 may be a sling strap 18, and from the front side 16 (or near the front side 16) may extend another strap 19. The sling strap 18 may widen as it extends further from the rear side of the pillow 17. The inner side of the sling strap 21 is primarily shown in FIG. 1. The strap 19 on or near the front side of the pillow 16 may be attached to a buckle 22. On the side of the buckle 22 opposite from the strap 19 may be a means for adjusting the strap length, such as a strap with adjustable length 23, allowing the length of the adjustable strap 23 to vary according to user preference, for example so that a wider portion of the sling strap at a lower sling portion 20 will comfortably and stably hold the crossed forearms of the person using the device. The buckle 22, the strap 19, and the adjustable strap 23 may also provide a means for connecting and disconnecting, such as, in the embodiment described herein, a female end of the buckle 22 attached to the strap 19, and a male end of the buckle 22 attached to the strap with adjustable length 23.

Figure 2:
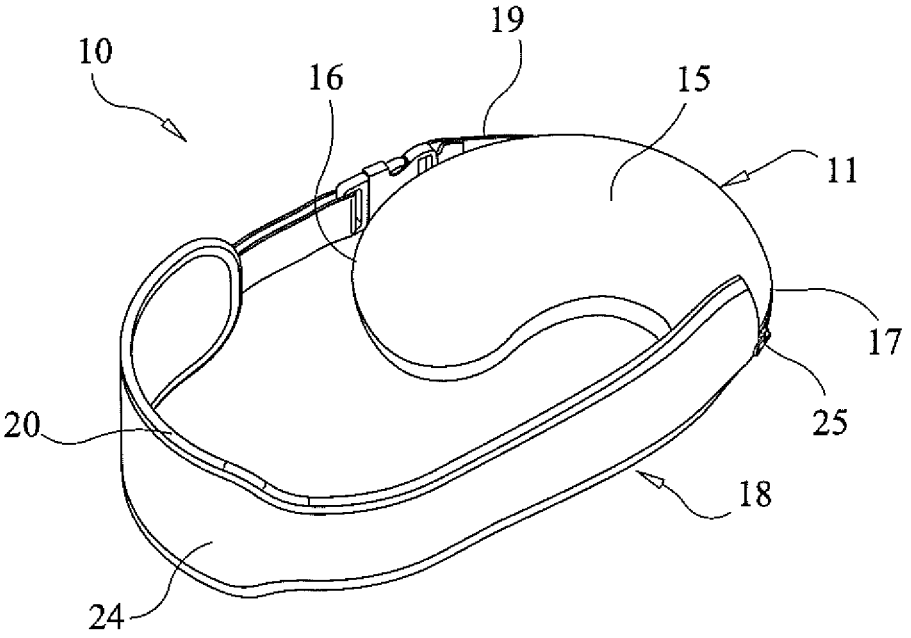
FIG. 2 is an overhead perspective view of the sleeping aid device in FIG. 1, but showing the bottom side of a pillow and the outer side of a sling strap.

As shown in FIG. 2, the sleeping aid device 10 may be rotated 180 degrees along the vertical axis, in such a manner that the bottom side of the pillow 15 faces upwards (which might be convenient for use on an opposite shoulder). FIG. 2 also shows primarily an outer side 24 portion of the sling strap 18 and the wider portion of the sling strap 20. In one embodiment of the sleeping aid device 10, there may be a zipper 25 (or other means for opening the pillow 11), close to where the sling strap 18 is connected to the back side of the pillow 17.

Figure 3:
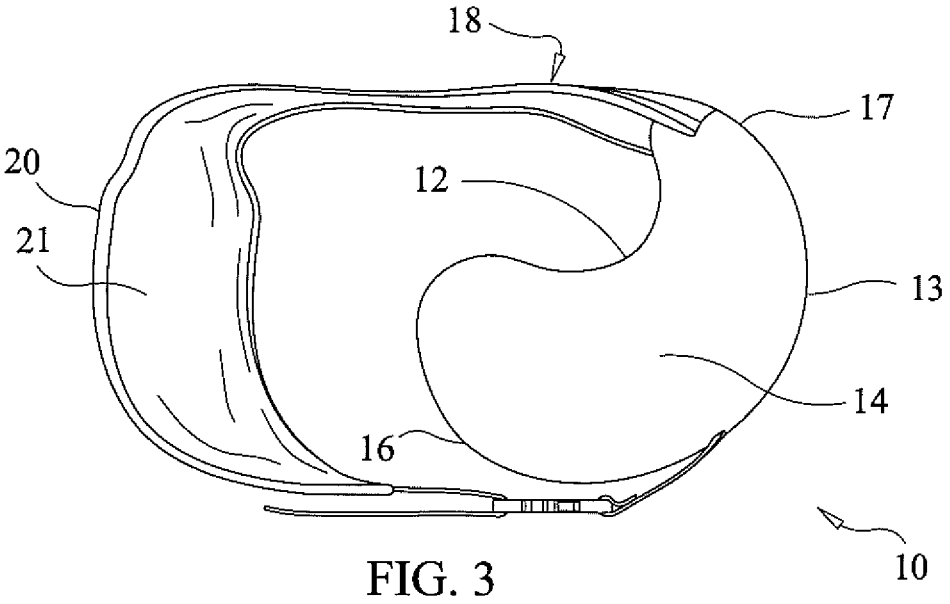
FIG. 3 is an overhead view of the apparatus in FIG. 1 of the side pillow and the inner side of the strap.

FIG. 3 is an overhead view of the sleeping aid device 10, showing the top side of the pillow 14, and the inner side 21 of the sling strap 18 and the wider portion of the sling strap 20. FIG. 3 also shows more precisely an overhead view of the tear-drop shape of the pillow 11, which in the embodiment described herein may have an inner side 12, an outer side 13, and front side 16, and a rear side 17, where the front side 16 is larger than the rear side 17.

Figure 4:
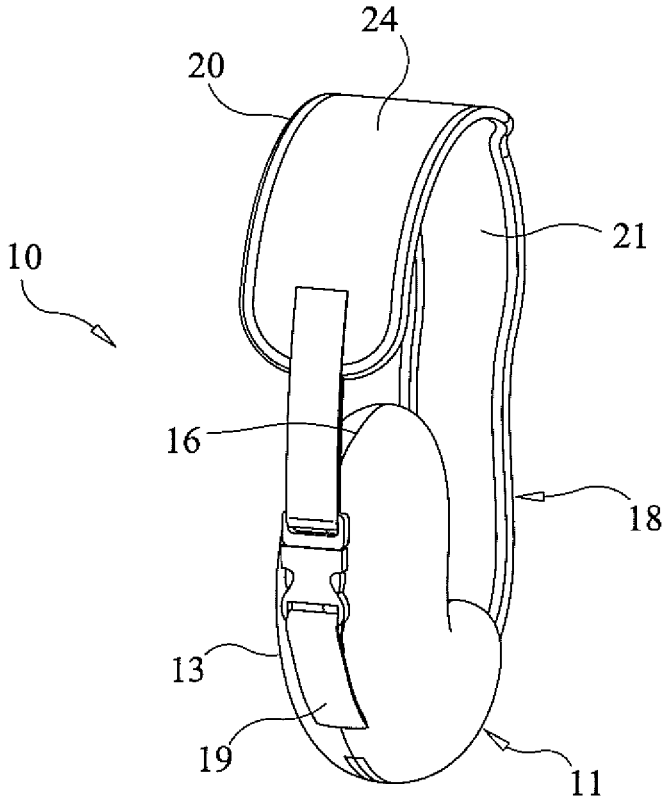
FIG. 4 is an elevation perspective view of the front and outer side of the pillow in FIG. 1, and of the strap in FIG. 1.

FIG. 4 is an elevation perspective view, showing primarily the outer side of the pillow 13, and the front side of the pillow 16, where the strap 19 connects to the pillow 11. FIG. 4 also shows the shape of the sling strap 18 and the wider portion of the sling strap 20, and also shows both the inner side 21 and the outer side 24 of the sling strap 18 and wider portion thereof 20.

Figure 5:
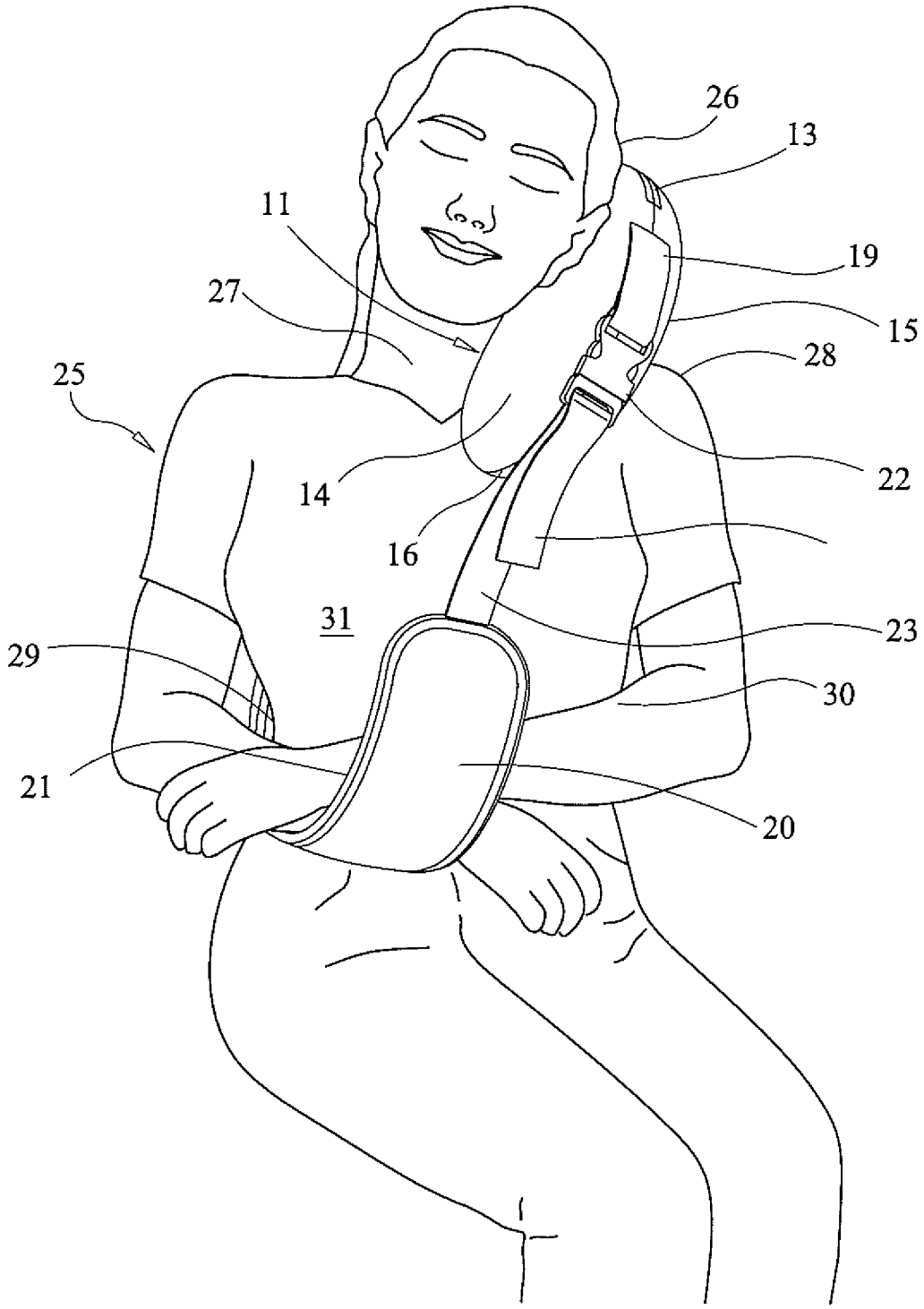
FIG. 5 is a front view of a person in a seated position using the sleeping aid device in FIG. 1.

Although the pillow 11 may rest on either shoulder 28 according to the preference of the user 25, as shown in FIG. 5 a person 25 may position the sleeping aid device 10 so that the top side of the pillow 14 is against side of a head 26 and a neck 27 of the person 25, and the bottom side 15 may be against a shoulder 28. Also, the front side of the pillow 16 may face forward, with the outer side of the pillow 13 facing up. (Positioning the pillow 11 in such a manner may provide less mass in the back of the head 26 area than prior art sleeping aid pillow apparatuses, which design might be advantageous where seats may already provide support for the back of the head 26 and neck 27 through headrests or similar apparatuses.)

As further illustrated in FIG. 5, the strap 19 attached to the pillow 11, the buckle 22, and the strap with adjustable length 23 may proceed down across a body 31. The strap with adjustable length 23 may be attached to the wider portion of the sling strap 20, which may continue to the side of the person that is opposite 29 from the shoulder 28 upon which may be the pillow 11.

The sling strap 20 may have a length sufficient to allow both forearms 30 when crossed to be rested on its looped length, along the inner side 21 of the wider portion of the sling strap 20. The lower sling portion of the sling strap 20 has a predetermined sling width configured to be sufficient to stably support both forearms 30 crossed thereon by support and/or frictional forces thereof. For example, in one embodiment the width of the lower sling portion 20 may be in the range of 4 inches to 6 inches wide so that it can provide adequate holding and support forces to stably retain the crossed forearms of a person using the device 10 thereon. The width of the lower sling portion of the sling strap 20 may continue around the side of the person 29 opposite from the shoulder 28 upon which may be the pillow 11, and the sling strap 18 may continue across the back of the body 31 of the person 25 until it attaches to the pillow 11. The force of the arm members 30 against the inner side of the sling strap 21 may consequently apply force on the pillow 11 against the side of the head 26 and neck 27 of the person 25 from an at least semi-lateral angle. The degree of such applied force may vary, among other factors, according to the length of the strap with adjustable length 23, the position of one or both forearms 30 in the inner side of the sling strap 21, and whether one of both arms 30 are placed in the inner side of the sling strap 21. In the embodiment described herein, the degree of force may be such that the pillow 11 is held taut and firm against the side of the head 26 and neck 27, which may allow the head 26 to be propped up but still possibly turned or tilted (however slightly) to the side, and which may support the head 26 at a sufficient angle to achieve a comfortable head 26 and neck 27 position.

Figure 6:
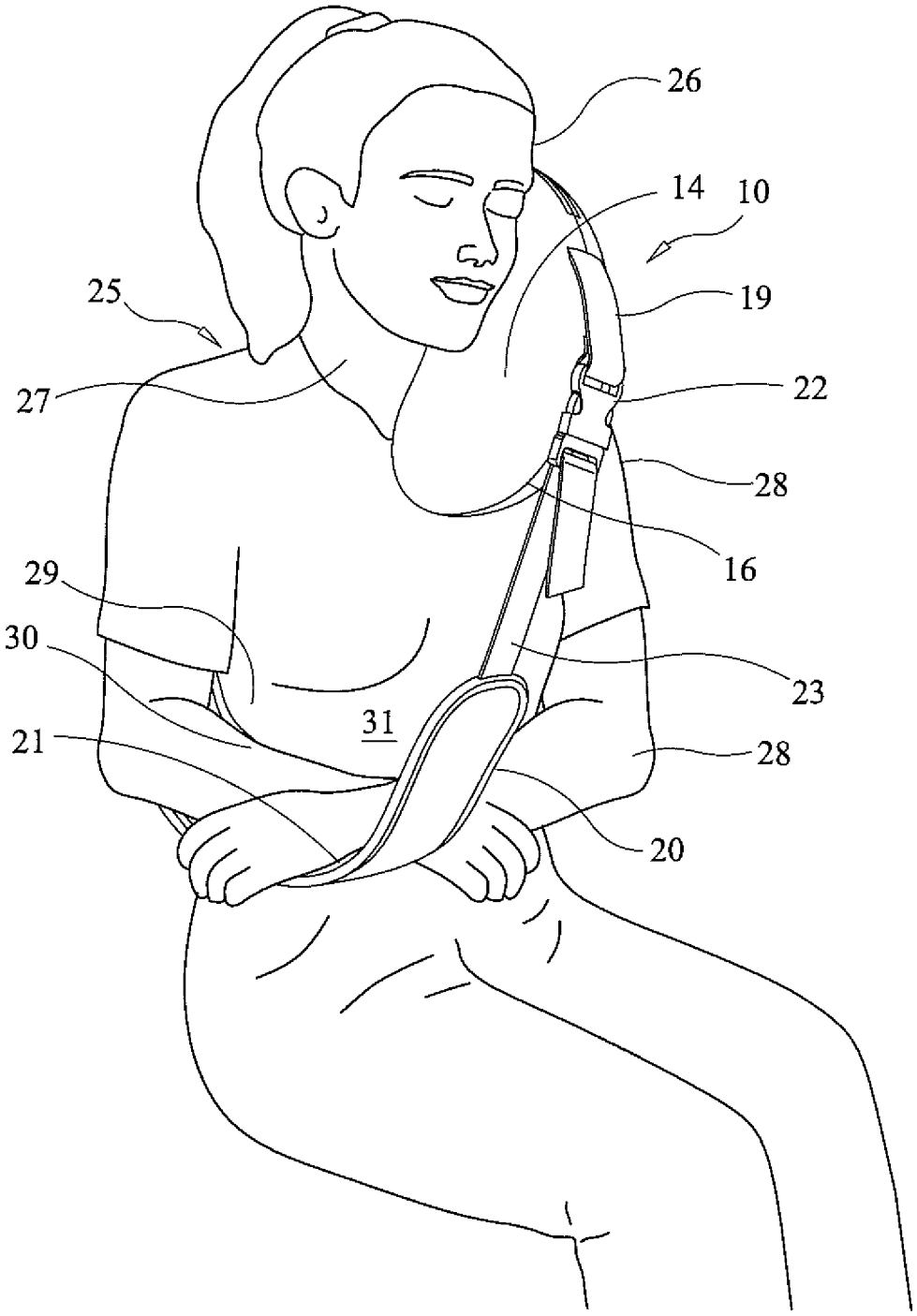
FIG. 6 is a side perspective view of a person in a seated position using the sleeping aid device in FIG. 1.

In addition to a person's head 26 resting against the pillow 11 to the side as shown in FIG. 5, as illustrated in FIG. 6 a person 25 may also have the body or torso 31 at least partly turned towards the side, but otherwise with the sleeping device 10 in a similar position (to that shown in FIG. 5). That is, the front side of the pillow 16 may face forward and maybe face slightly downward, with the top side of the pillow 14 (or the bottom side 15 if the pillow were on the opposite shoulder from the shoulder 28) against the head 26 and neck 27 of the person 25, and the strap 19, buckle 22, strap with adjustable length 23, and wider portion of the sling strap 20 running across the body 31 down and to the side of the of the person 29, and the wider portion of the sling strap 20 and the sling strap 18 running across the back side of the body 31 until it connects to the pillow 11. One or both forearms 30 may also be placed in the inner side 21 of the wider portion of the strap 20, thereby applying a certain amount of force through the pillow 11 against the head 26 and neck 27 from an at least semi-lateral angle, and also allowing one of both arm members or forearms 30 to rest comfortably, held close to the body 31.

While the above preferred embodiment has been described as having a pillow with a tear-drop shape, the pillow may alternatively be formed in a half-moon shape with two tapered ends on opposite sides thereof for connecting to respective ends of the sling strap.

Figure 7:
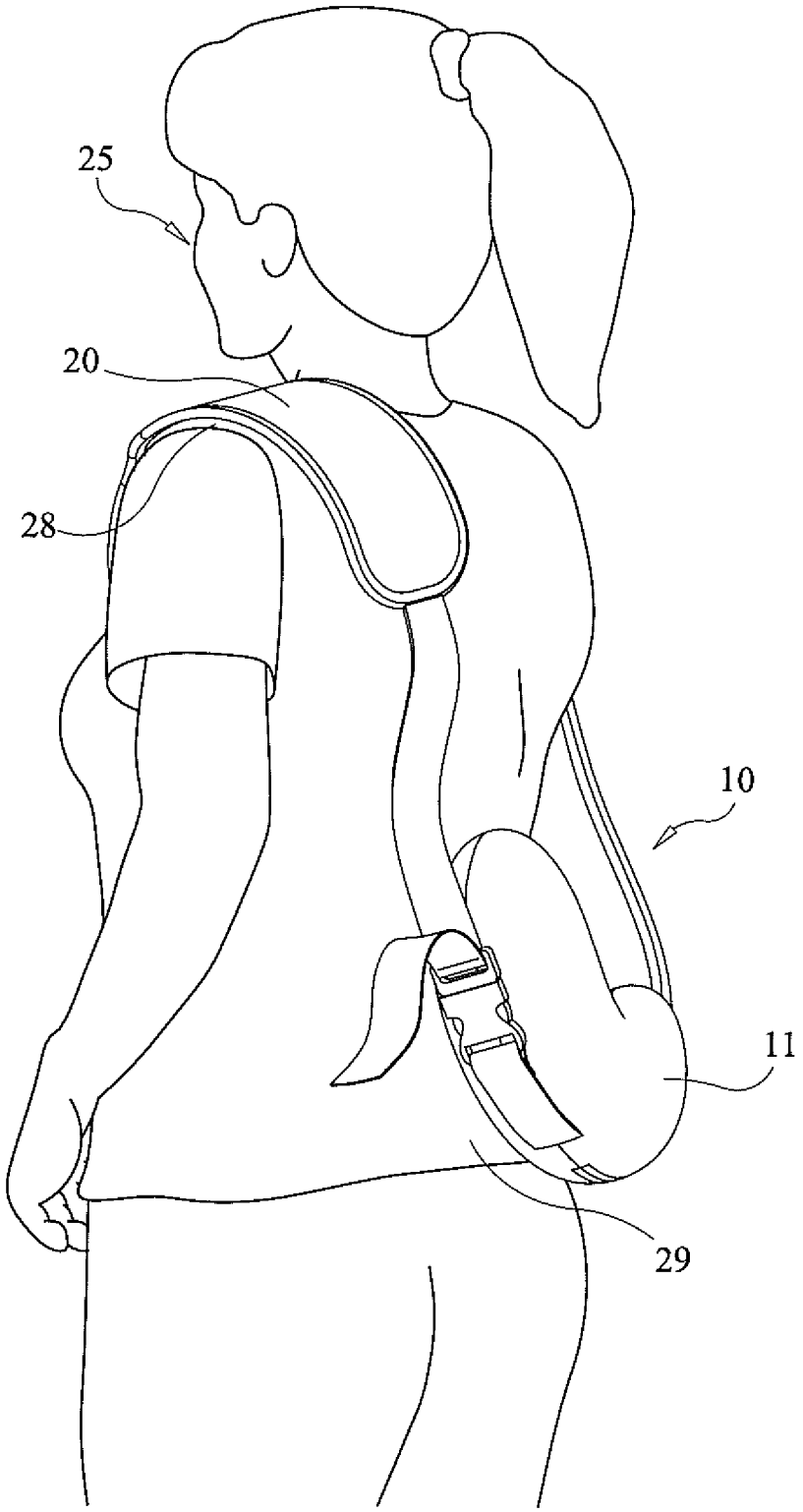
FIG. 7 is a rear perspective view of a person conveniently transporting the sleeping aid device of FIG. 1, in a manner resembling the carrying of a shoulder bag or purse.

In addition to a sleeping aid device 10 that may provide added comfort and increased possibility and quality of rest, travelers have a need for a sleeping aid device 10 with convenient portability. Thus, as illustrated in FIG. 7, by a person easily 25 shifting the pillow 11 from the shoulder 28 to the side 29, with the wider portion of the strap 20 resting on the shoulder 28, an embodiment of the device 10 may naturally appear similar to species of purses or bags, and allow for less conspicuous portability. This embodiment may assist in avoiding the potentially time-consuming disassembling or storing away a sleeping aid device 10, for example, by deflating or folding it up, or having to transport it by carrying it manually (rather than simply having it strapped onto the shoulder 28).

Figure 8:
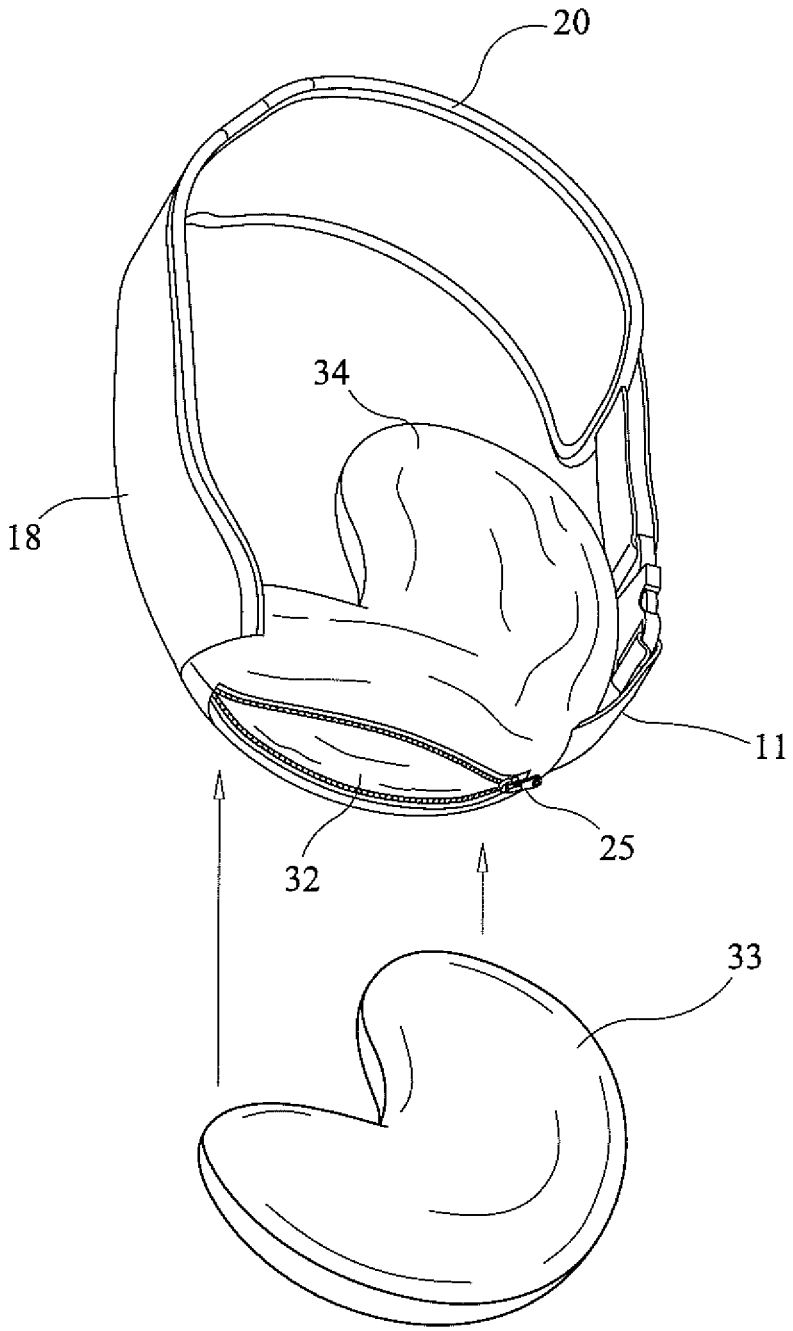
FIG. 8 is a side perspective view of an embodiment of the sleeping aid device of FIG. 1 where a cushion may be inserted into and removed from a receptacle.

Furthermore, as shown in FIG. 8, an embodiment of the sleeping aid device 10 may actually function as a purse of bag. Specifically, the pillow 11 may have a receptacle 32 that may open, (in the embodiment described herein) by means of a zipper 25, and may have a cushion 33 that may be removed from or inserted into the receptacle 32. In different embodiments the cushion may be made of different materials such as those known in the art(s) to which the device 10 pertains. For example, the cushion 33 may be inflatable. By deflating, there may be more room within the receptacle 32 for storing objects. Removing the cushion 33 from the receptacle 32 may also help allow for easier washing of the device 10, Different embodiments of the outside of the pillow 34, as well as of the sling strap 18 and the wider portion of the sling strap 20, may provide aesthetic appeal and as well as textural appeal (pleasing to the physical senses).

Figure 9:
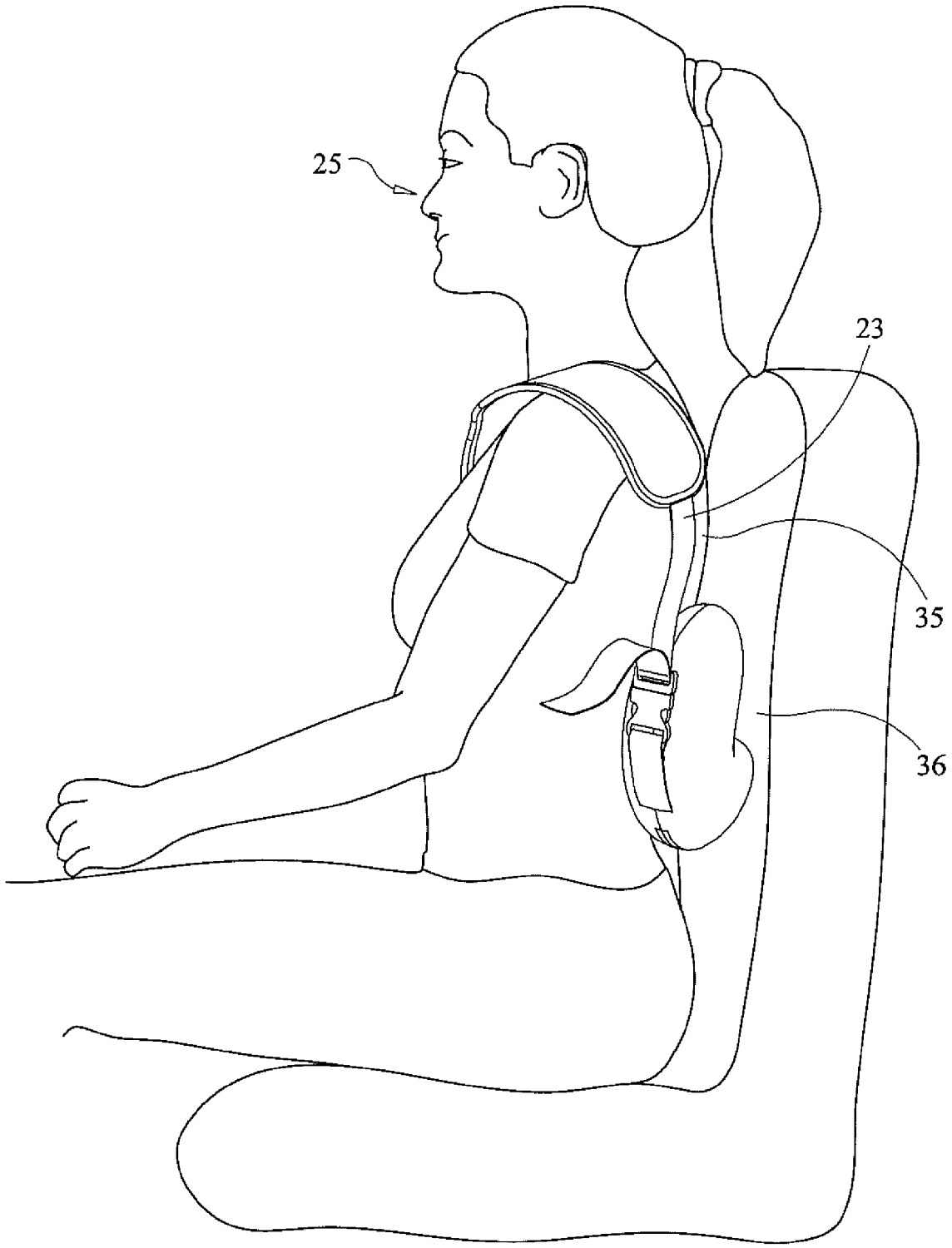
FIG. 9 is a side perspective view of a person in a seated position using the device in FIG. 1 as a lumbar support.

In another embodiment, and as shown in FIG. 9, the device 10 may also be used as a lumbar support. Specifically, a user 25 may position the pillow 11 against the person's back 35, possibly by adjusting the adjustable strap 23, so that the pillow 11 is between the person's back 35 and a seat 36, in a manner that is comfortable to the user 25.

I claim:

1. A sleeping aid device, which is configured for use by a person to provide support to one side of the person's head and/or neck toward one shoulder when the person is seated and using the device, said device comprising:

a pillow configured to be placed on one shoulder of the person to provide support against one side of the person's head and/or neck in a direction toward the one shoulder, and a sling strap having a length between respective ends thereof, the sling strap being connected to opposite ends of the pillow and configured to be positioned around the one shoulder on front and back sides of the person to form a loop, the sling strap having a lower sling portion configured to stably support at least one of the person's forearms so that opposing forces acting on the at least one forearm through the sling strap disperse across a non-localized area of the at least one forearm, wherein, the pillow and the sling strap are operable together so that when the at least one forearm rests on the lower sling portion and the pillow is placed against the side of the head and/or neck of the person on the one shoulder, the weight of the at least one forearm generates a force on the pillow that is transferred to the neck, head, and/or shoulders of the person.

2. The device of claim 1, wherein the sling strap is comprised of a first strap portion connectable to a second strap portion, wherein the first strap portion includes the lower sling portion having the width sufficient and configured to stably support the at least one forearm of the person, and an adjustment member is provided for adjustment of the length of the second strap portion.

3. The device of claim 2, wherein the width of at least the lower sling portion of the first strap portion is wider than a width of the second strap portion.

4. The device of claim 2, wherein the second strap portion has a connecting member for connecting and disconnecting it to and from the first strap portion.

5. The device of claim 2, wherein the adjustment member for adjusting the length of the second strap portion is a buckle.

6. The device of claim 2, wherein the pillow has a tear-drop shape with a bulging portion to provide support to the person's head and/or neck, and a tapering end adapted to be connected to the sling strap on the front side of the person.

7. The device of claim 6, wherein the first strap portion is attached to a back side of the tear-drop shape of the pillow, and the second strap portion is connected to the tapering end of the pillow adapted to be placed on the front side of the person.

8. The device of claim 1, wherein the sling strap is configured to be adjusted in length so that its ends connect to the pillow when placed on the shoulder and forms a loop around the back side and with the lower sling portion positioned on the front side of the person.

9. The device of claim 8, wherein the at least one forearm includes first and second forearms that crossed at right angles, and the length of the sling strap is adjusted so that the lower sling portion is positioned where the forearms are crossed.

10. The device of claim 1, wherein the pillow has an outer cover, a receptacle, and an interchangeable pillow bladder.

11. The device of claim 10, wherein the interchangeable pillow bladder is inflatable.

12. The device of claim 10, wherein the interchangeable pillow bladder is interchangeable by opening and closing an aperture in the outer cover of the pillow.

13. The device of claim 10, wherein the outer cover of the pillow and the receptacle are configured as a purse or bag.

14. The device of claim 1, wherein the pillow has a removable outer cover.

15. The device of claim 14, wherein the removable outer cover is machine washable.

16. The device of claim 2, wherein the pillow has a half-moon shape with a bulging portion to provide support to the person's head and/or neck, and opposite tapering ends adapted to be connected to respective ends of the sling strap on the front and back sides of the person.

17. A sleeping aid device, for use when a person is seated, said device comprising:

a pillow having a half-moon shape with tapered ends and a bulging portion to provide support to the person's head and/or neck, a sling strap having a length between respective ends thereof, the sling strap connected to the tapered ends of the pillow on front and back sides of the person and configured to be positioned around the front and back sides of the person, the sling strap forming a loop and having a lower sling portion thereof configured to stably support the person's forearms, which are crossed, the lower sling portion configured to disperse forces acting on the forearms through the sling strap across a non-localized area of the forearms, wherein, the pillow and the sling strap are operable together so that the forearms of the person stably rest on the lower sling portion and the pillow is placed against the person's head and/or neck in such a manner that a weight of the person's forearms generates a force on the pillow that provides support to the head and/or neck of the person, and the forces acting on the pillow, the neck, head, and/or shoulders of the person and the weight of the person's crossed forearms supported by the lower sling portion are substantially in a state of equilibrium.

18. The device of claim 17, wherein the sling strap is comprised of a first strap portion connectable to a second strap portion, wherein the first strap portion includes the lower sling portion having a width wide enough to stably support the forearms of the person crossed therein, and an adjustment member is provided for adjustment of the length of the second strap portion.

19. The device of claim 17, wherein the length of the sling strap is adjustable so that the ends of the sling strap connect to the pillow, and the sling strap forms a loop around the back side of the person, with the lower sling portion positioned on the front side of the person.

20. The device of claim 19, wherein the length of the sling strap is adjustable so that the lower sling portion is positioned where the person's forearms are crossed at right angles with elbows of the person.

* * * * *